United States Patent [19]

Stewart

[11] Patent Number: 4,752,260

[45] Date of Patent: Jun. 21, 1988

[54] AQUATIC BODY BOARD

[76] Inventor: Michael Stewart, 75-5722 Kuakini Hwy., No. 210, Kaila Kona, Hi. 96740

[21] Appl. No.: 882,950

[22] Filed: Jul. 7, 1986

[51] Int. Cl.[4] ..... A63C 5/04

[52] U.S. Cl. ..... 441/65; 441/74

[58] Field of Search ..... 114/39.2; 280/12 B, 280/18; 441/65, 66, 62, 74, 79; D21/228

[56] References Cited

U.S. PATENT DOCUMENTS

D. 194,646 2/1963 Del Mar ..... D21/228

4,571,195 2/1986 Brooks, Jr. ..... 441/74

FOREIGN PATENT DOCUMENTS 3,105,315 9/1982 Fed. Rep. of Germany ..... 114/39.2

*Primary Examiner*—Sherman D. Basinger

*Assistant Examiner*—Edwin L. Swinehart

*Attorney, Agent, or Firm*—Blakely, Sokoloff, Taylor & Zafman

[57] ABSTRACT

The present invention is an improved body board for use in the ocean surf, the improvements being a substantially vertical step in the lateral edges to increase the speed by allowing the water to shear off the side; a raised portion in the upper surface to provide greater leverage to the rider in controlling turns on the body board; and a dimpled portion in the center thereof below the rider's body to provide both a lubricating effect and an adhesion effect between the rider's body and the body board.

14 Claims, 2 Drawing Sheets

AQUATIC BODY BOARD

FIELD OF THE INVENTION

This invention relates to boards used for aquatic sports such as surfing, and more particularly, to an improved body board or "belly" board of a type where the rider lies down with his torso supported in the water by a body board.

BACKGROUND AND PRIOR ART

Surf boards and body boards have been known for a long time and are in extensive use along the seashores and coasts throughout the world. Recently, the so-called body boards have become popular and are used in great numbers by young and old for fun at the beach. In addition, even more recently, professional body boarding and amatuer body boarding contests have been established throughout the world and refinements of body board designs and riding techniques have been developing rapidly.

Unlike surfing, where a rider stands upright on a relatively long and narrow surf board, a body board is a relatively short, blunt-nosed wide board on which the rider lies down with his torso on the board and holds the sides or top of the board for riding the surf onto the beach. In general, riding a body board requires considerably less skill than surfing and is therefore amenable to the participation of people of all ages.

Unlike a surf board, a body board is relatively sluggish in response to body movements intended to steer the board in the water. A standing surfer can lean in the direction he wants to steer and is also free to step forward or backwards on the board to obtain a desired response from his board. On the other hand, a rider of body board does not have this freedom of movement. The rider generally lies down with his chest or pelvis on the board and grasps the sides or forward end of the board with both hands for the purpose of staying on the board. Thus, the steering of the board must be achieved by shifting the rider's weight by rolling or sliding his body on the board.

To turn the moving body board, one rail of the board must be pushed downward into the water so that more of the rail of the body board is placed in contact with the water. The surface tension of water moving along the bottom and rail of the board causes the water to attempt to adhere to the rail of the body board. The increased surface area of the body board placed in contact with the water, in combination with the effect of the adhesion of the water to the rail of the body board causes increased resistance or drag in the water on the side of the board pushed down into the water, which, in turn, pulls the board in that direction. To angle the board relative to the water, the rider presse down against the side of the board with his forearms or elbows to create the desired resistance or drag of the board in the water which slows down that side and turns the board. Leaning or shifting the rider's weight to the left turns the board to the left, and conversely, leaning or shifting the rider's weight to the right turns the board to the right. The harder one leans, or in other words, the more weight one places on the furthest leverage arm of the central line of the board, the more resistance is created, and in turn, the faster the board turns.

In order to facilitate or accentuate the turns, a rider sometimes slides from side to side along the board in order to assist the shifting of his weight or up and down along the board to modify his drag and balance in the water. In particular, the board travels faster when weight is distributed toward the front of the board thereby eliminating the drag of the rider's legs in back of the board. Thus, in order to control speed it is necessary to be able to shift a rider's weight forward and backward for various maneuvers.

The prior art body boards have a top surface which is generally smooth allowing the rider to freely slide on the board's surface. However, in certain situations such as tight turns and other fast maneuvers, it is desirable to maintain a reasonable amount of traction on the board. None of the surfaces of the prior art provide a surface which is selectively slippery or resistant depending upon the rider's need and body positioning.

Also, with the advent of advanced riding techniques, the more skilled riders have expressed a need to achieve faster speeds than are currently being achieved using the prior art body board designs. In this connection, the side rails of most of the present body board designs are shown in FIG. 7 of the drawings, are set at an obtuse angel $\theta$ relative to the horizontal hull plane. As a result of this shape, the body boards passes through the water with a certain resistance due, in part, to the path of the water which adheres to the diagonal rail as it cuts through the water. The adherence of the rail causes the board to travel at a relatively slow speed to the water because its contact with the water along its long surface area creates resistance on the board through the water.

The foregoing problems are overcome by the present invention described in brief below.

SUMMARY OF THE INVENTION

The present invention comprises a body board having several novel and non-obvious features. The present invention is an improved body board which is provided with a side rail having a first portion, or step, substantially vertical and perpendicular or near perpendicular to the plane of the hull, and a second portion which angles outward diagonally in the same manner as the prior art boards. The step on the side rail provides a sheer surface off of which the water breaks thereby decreasing the resistance of the body board through the water. However, when the rider forces the edge of the body board into the water for turning, the same surface area and the same drag as is known in the prior art is applied by means of the diagonal portion of the side rail.

The body board is also provided with a raised portion on the top surface on the sides where the rider places his forearms and elbows. This raised portion provides increased leverage which enables the rider turn to faster with somewhat less effort and provides the board with a more responsive ride. The raised portion extends from each edge of the board and tapers down toward the middle. The raised portion also provides a slight cup-like form to the board so that the rider's body, is to a small extent, centered in the center of the board. Thus, the edges of the invented body board are slightly thicker than the a conventional body board and the center is substantially the same depth as a conventional body board.

The invented body board is also provided with dimples on its top surface in the portion on which a user places his torso. Said dimples are provided in the center portion of the body board beginning approximately one-third of the way back from the front of the board.

The dimples provide a dual advantage to the rider. As the rider places his body on the board, water filling the dimples appears to provide a lubricating surface which allows the rider to slide his body forward and backward along the board. The dimples are generally rounded in the preferred embodiment are oval shaped so that they provide slightly less resistance to the forward and backward motion of the rider relative to a side-to-side motion. However, side-to-side motion is permitted. Once the rider places his body on the dimples for a relatively short period of time, and the water is squeezed out or partially squeezed out from the dimples and the rider's body is frictionally held in place thereby reducing slipping or sliding on the board. The rider's skin or clothing conforms to a small extent to the shape of the dimple in a suction cup-type arrangement.

Also in the preferred embodiment, small channels are provided in the top portion of the board on the sides adjacent the dimpled portion. These channels are diagonal to the long axis of the board and allow the rider to slide his body backward and sideways relative to the board. This backwards and sideways movement is the usual movement involved in negotiating a turn of the board. The channels also provide resistance against slipping directly back on the board which is the conventional force a rider has to resist.

DETAILED DESCRIPTION OF THE INVENTION

Figure 1:
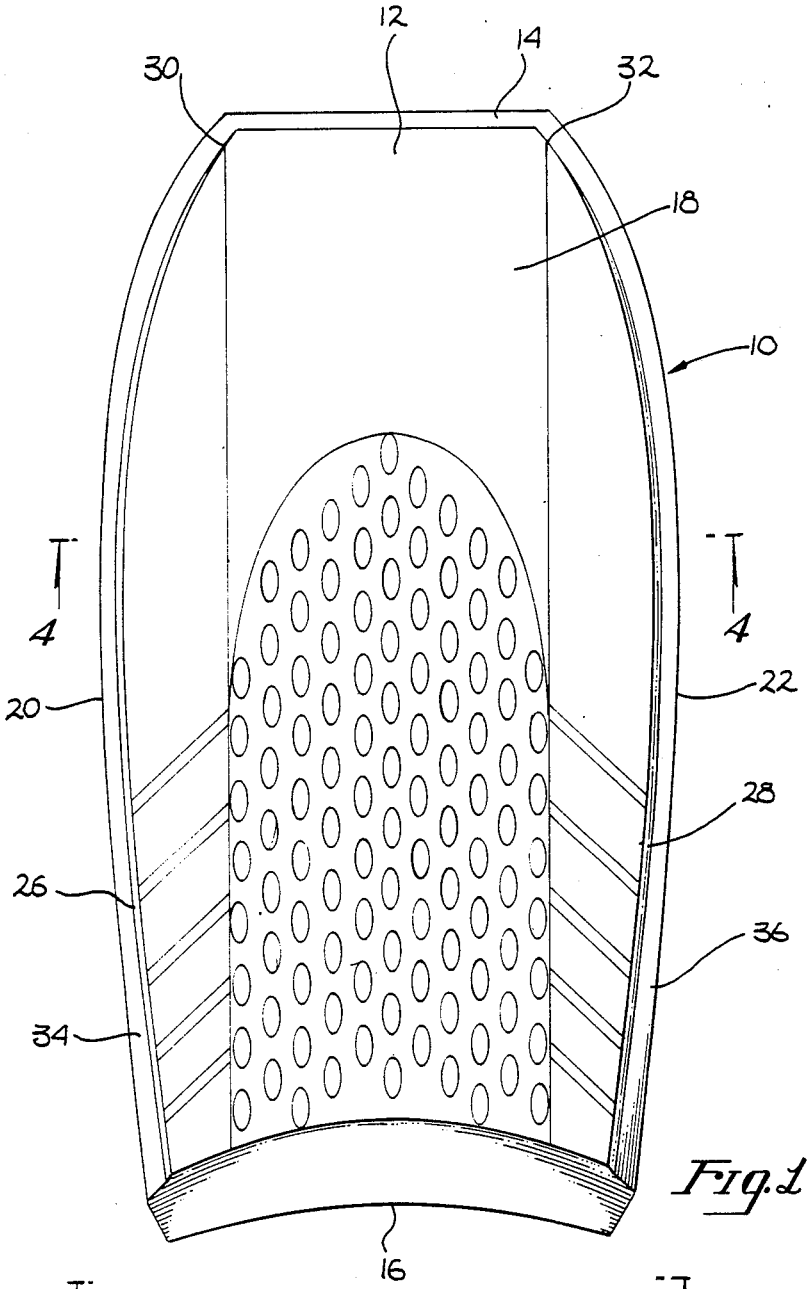
FIG. 1 is a top perspective view of the invented body board according to the present invention.
Figure 2:
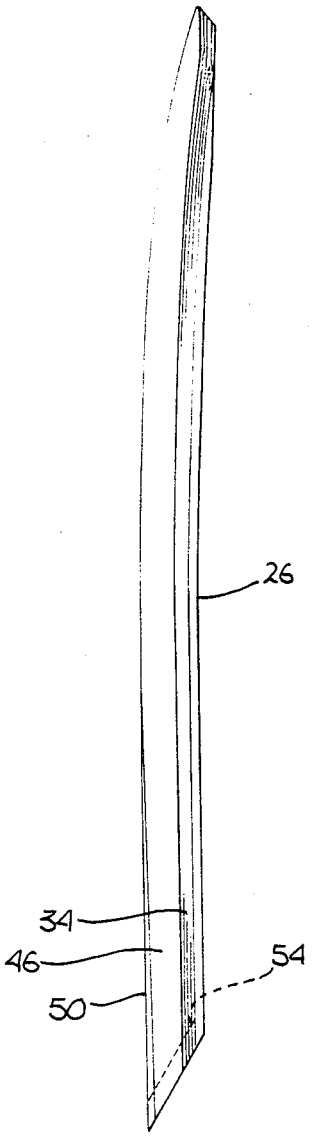
FIG. 2 is a side view of the invented body board.
Figure 3:
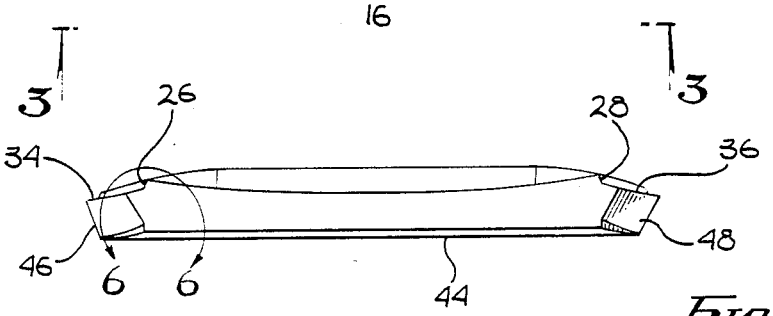
FIG. 3 is a rear end view of the invented body board taken through lines 3—3 of FIG. 1.
Figure 5:
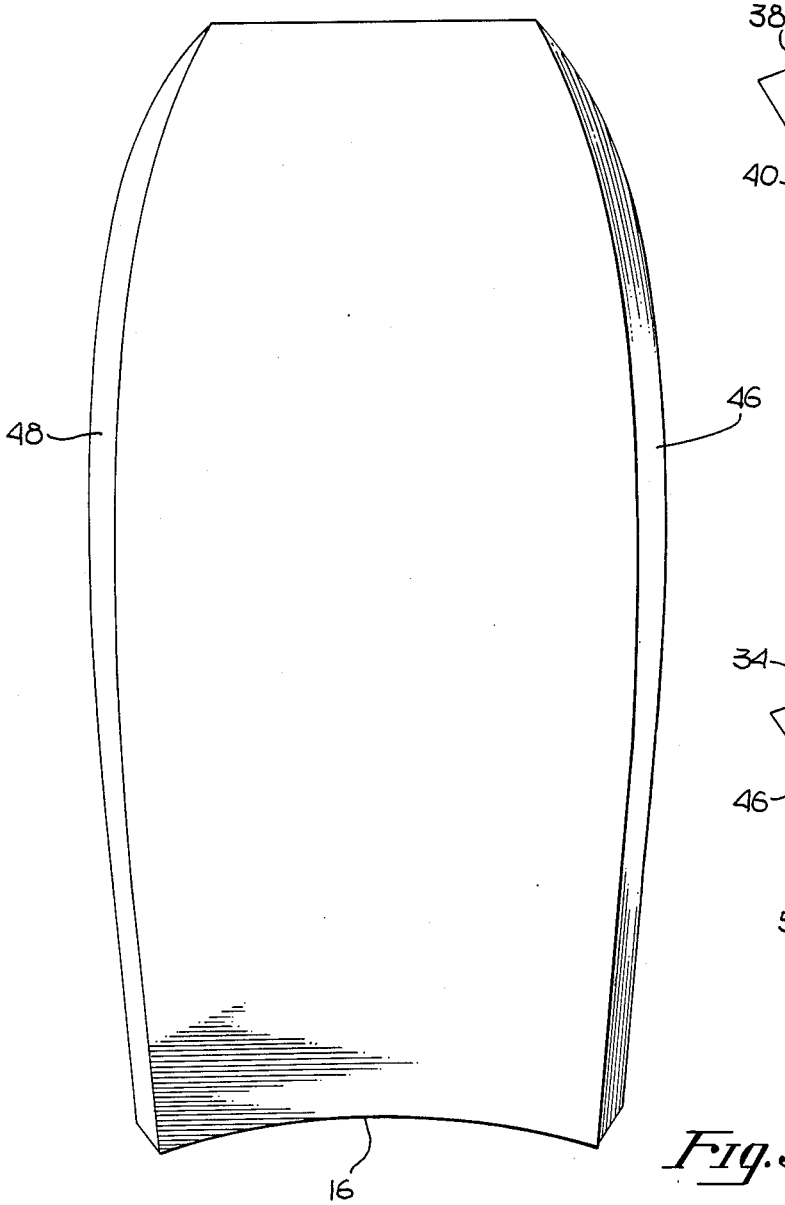
FIG. 5 is a bottom plan view of the invented body board.

Turning first to FIG. 1 of the drawings, a body board 10 comprising a straight blunt forward end 14, a generally curved rear end 16, a top surface 18, and side rails 20 and 22, and chines 21 and 23. The ghost line 25 in FIG. 2 shows the rear of the body board at its midline. The boards are generally made of soft, light-weight material and may be up to three or four inches in thickness. The boards are usually laminated with foam polyethylene or an extruded polyethylene or polyvinyl chloride, glass fiber or other sheeting material, or compositions comprising different types of foam having varying stiffnesses. Preferably, the boards are relatively stiff and are made of composite materials such as polyethylene and copolymers, such as polyethylene and polystyrene and are coated with extruded polyethylene or polyvinyl choride.

The improved body board of the present invention, as illustrated in FIG. 1, includes raised leverage panels 26 and 28 respectively on the top surface 18 of the invented body board. The raised leverage panel 26, as shown in FIGS. 1, 2, 3, 4 and 6 preferably runs substantially entirely along the longitudinal length of the body board 10. Across the width of the body board 10, the raised leverage panel 26 terminates at approximately the line designated by the numeral 34 and the raised leverage panel 28 terminates approximately at the line designated by the numeral 33. Ideally, the raised leverage panels 26 and 28 are of sufficient width that a rider's elbows will be placed thereon at all possible body positions. However, the specific height and width of the raised leverage panels 26 and 28 can very widely and will generally be a matter of design choice.

Figure 7:
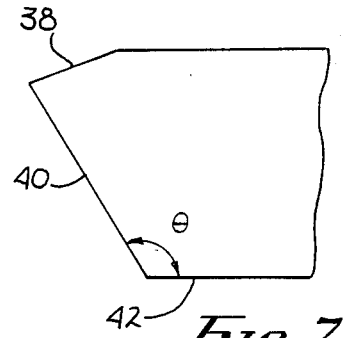
Fig. 7 PRIOR ART
FIG. 7 shows an end view of the rail of a prior art body board.
Figure 6:
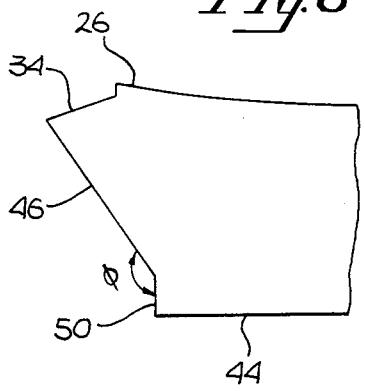
FIG. 6 is an end view of the rail of the invented body board taken through line 6—6 of FIG. 3.
Figure 4:
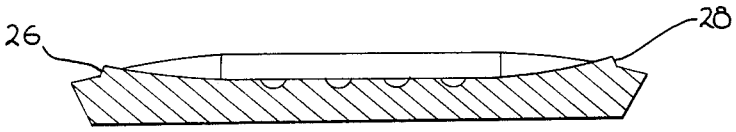
FIG. 4 is a cross-sectional view of the invented body board taken through lines 4—4 of FIG. 1.

A comparison of FIGS. 6 and 7 will show that raised leverage panel 26 present in FIG. 6 showing the invented body board is not present in FIG. 7 which illustrates the shape of the rail in the prior art.

The raised leverage panels provide the rider with better control over the ability of the body board to turn relative to flat body board designs. The raised leverage panels also provides the invented body board with a slight indentation which permits the rider to center his body in relation to the width of the board. In this connection, to turn the board in the water, the rider using his elbows or forearms forces the edge of the board into the water by applying his weight downward on the side to which the rider desires to turn.

The raised leverage panels may be the size of the user's elbow and forearm, or in the alternative, may run the length of the board 10 as shown in the drawings, as noted above. The panel can be made of a softer, more resilient material which would be comfortable to the rider's elbows and forearms so that even when a hard material is used as the core of the body board, the material on which the elbows and forearms is placed is relatively comfortable.

As another benefit to the invented inclined leverage panels, many prior art boards breakdown first as a result of constant pressure of the rider's elbows in a particular location or area of the board. This breakdown is evidenced by indentations permanently placed in the top surface of the body board where the rider places his elbows. By providing the raised leverage panels of the present invention, even when indentations are formed in the top surface, they do not extend deep enough into the board to created permanent damage to the core of the body board.

FIG. 7 illustrates an enlarged section of a side of a prior art body board. As shown, the prior art body board comprises a planar side rail 40 disposed at an obtuse angle $\theta$ relative to the hull 42. Also shown are the chine and top surface of the prior art body board.

In comparison, in the present invention, the prior art side rail has been modified thereby enabling the body board to travel faster through the water than prior art boards, as described below. The moved feature of the rail of the present invention is a step 50, which is a thin elongated substantially planar or triangular panel substantially perpendicular to the hull 44. The height of the step at the rear of the body board is preferably about one-tenth (1/10) of the board of the depth or thickness of the body board 10, although it is anticipated that the invented body board can accomodate much variation in the size of the step 50. As shown in FIG. 2, the step 50 gradually tapers toward the front of the board, and terminates near the middle of the board 10. Due to the anticipated mode of action of the step 30, it is believed that it would have minimal effect along the sides of the front half of the body board 10.

Side rail 46 is disposed above step 50, and functions in a manner similar to side rail 40 of the prior art. Side rail 46 is disposed at an angle $\theta$ relative to step 50 (which is geometrically equivalent to the angle of the intersection between the line defined by side rail 46 and hull 44). Angle $\theta$ is similar to angle $\theta$ of the prior art.

The step 50 is effective in reducing the resistance of the body board through the water. Without being bound to any particular scientific theory, it appears that the lower resistance, is a result of the sharp angle between the hull 44 and the step 50 along the back portion of the body board. As a result of this angle, the water traveling along the hull 10 shears off the hull and away from the step 50 and rail 46. On the other hand, referring to FIG. 7, using a prior art, body board, the water would come off the hull 42 and travel along the side rail 40 so that the surface area of the rail 40 remains in contact with the water shearing off the hull 42. This continuous contact with the water causes increased resistance of the body board through the water which slow the body board down in the water.

As contemplated by the present invention, step 50 does not need to be completely vertical (perpendicular to hull 44) but may be disposed at any angle substantially close to perpendicular with improved efficiency and decreased resistance as the angle between step and hull approaches perpendicular. The size of the step can vary depending upon the material from which the body board is constructed, the weight of the rider relative to the boyancy of the board and similar factors.

The present invention may also include a section on the topside 18 of the body board having dimples or indentations thereon.

As shown in FIG. 1, the dimples are preferably oval shaped and of a minimal depth of one-eighth ($\frac{1}{8}$) to one-half ($\frac{1}{2}$) inch. The dimples cover the portion of the top surface 18 on which as rider generally places his torso, particularly his stomach, hips and sometimes the top of his thighs. The invented dimples provide a dual effect. When water is disposed therein, the dimples provide a lubricating effect allowing the rider to slide easily along the body board. The oval shape of the dimples permits freer movement of the rider front-to-back as compared with side-to-side motion.

When the rider firmly places his body on the board, water is squeezed out of the dimples and replaced with the rider's body, thereby forming a slight suction or gripping action, which in turn, secures the rider in place and prevents his body from sliding on the board.

The top surface 18 of the body board also comprises diagonal channels extending from the dimples to edges of the body board 10. The channels permit the runnoff of excess water on the board and allow the rider to slide backwards and sideways on the board to place his weight on a rear edge to effect turns.

The invented body board has been described herein including a number of interrelated features to improve its performance. It will be obvious to one of ordinary skill in the art that various modifications can be made to the features described as the preferred embodiments with departing from the spirit and scope of the invention which is defined by the claims appended hereto.

I claim:

1. In a substantially planar body board of the type used for supporting a rider's torso in ocean surf and having an upper side, substantially planar underside, a front and a back, and lateral edges, the improvement comprising:

each of said lateral edges comprising a thin substantially planar panel member substantially perpendicular to said underside, a rail member disposed at an obtuse angle relative to said panel member and a chine disposed thereabove;

said upper side comprising a dimpled portion in the middle of the upper side disposed below the torso of a rider in position thereon, whereby said dimpled portion permits a rider to slide on said board until sufficient pressure is placed on said dimples, and then, said rider is partially secured in position on said board by said dimples; and said upper side comprises diagonal channels disposed therein extended from the dimpled portion to the lateral edges thereof.

2. In a substantially planar body board of the type used for supporting a rider's torso in ocean surf and having an upper side, substantially planar under side, a front and a back and lateral edges, the improvement comprising:

each of said lateral edges comprising a thin substantially planar panel member substantially perpendicular to said under side, a rail member disposed at an obtuse angle relative to said panel member and a chine disposed thereabove, said panel member being tapered so that said panel member has a greater height at the back of said body board than near the front thereof, and said panel member terminating approximately midway between said front and said back of said body board.

3. The body board of claim 2 further comprising a raised portion on the upper side of said body board disposed thereon below a user's forearms and elbows in use.

4. The body board or claim 3 wherein said raised portion comprises a triangular cross-section having a raised end disposed near said lateral edge, and terminating near the middle of said body board forming a substantially smooth transition therewith, thereby providing a rider thereon with optimal leverage for positive steering control of said board under shifting load.

5. The body board of claim 2 further comprising a dimpled portion in the middle of the upper side thereof disposed below the torso of a rider in position thereon, whereby said dimpled portion permits a rider to slide on said board until sufficient pressure is placed in said dimples, and then, said rider is partially secured in position on said board by said dimples.

6. The body board of claim 5 further comprising diagonal channels disposed in the upper side from the dimpled portion to the lateral edges thereof.

7. The body board of claim 2 wherein said panel member is approximately one tenth of the height of said lateral edge.

8. The body board of claim 7 wherein said panel member is approximately one tenth of the height of said lateral edge at the back of said body board.

9. In a substantially planar body board of the type used for supporting a rider's toro in ocean surf and having an upper side, substantially planar under side, a front and a back, and lateral edges, wherein the improvement comprises each of said lateral edges comprising:

a substantially vertical and substantially planar panel member abutting and substantially perpendicular to said under side, said panel member being tapered so that said panel member has a greater height at the back of said body board than near the front thereof and said panel member terminating approximately midway between said front and said back of said body board;

a rail member abutting said substantially planar panel member and disposed thereabove at an obtuse angle relative to said panel member, said rail member being angled outward from said under side to said upper side; and a chine abutting said rail member and said upper side and being angled inward from said rail member to said upper side;

whereby in use ocean water upon which the body board is traveling shears off the underside of said body board without flowing along said panel member.

10. The body board of claim 9 wherein said panel member is approximately one tenth the height of said lateral edge.

11. The body board of claim 9 further comprising a raised portion on the upper side of said body board disposed below a user's forearms and elbows in use.

12. The body board of claim 11 wherein said raised portion comprises a triangular cross-section having a raised end disposed near said lateral edge and terminating near the middle of said body board, forming a substantially smooth transition therewith, thereby providing a rider thereon with optimal leverage for positive steering control of said board under shifting load.

13. The body board of claim 9 further comprising a dimpled portion in the middle of the upper side thereof disposed below the torso of a rider in position thereon, whereby said dimpled portion permits a rider to slide on said board until sufficient pressure is placed on said dimples, and then, said rider is partially secured in position on said board by said dimples.

14. The body board of claim 9 further comprising diagonal channels disposed in the upper side form the dimpled portion to the later edges thereof.

* * * * *